US010600363B2

(12) United States Patent
Li et al.

(10) Patent No.: US 10,600,363 B2
(45) Date of Patent: Mar. 24, 2020

(54) METHOD FOR DRIVING AN ARRAY SUBSTRATE HAVING A PLURALITY OF LIGHT EMITTING COMPONENTS

(71) Applicants: SHANGHAI TIANMA AM-OLED CO., LTD., Shanghai (CN); TIANMA MICRO-ELECTRONICS CO., LTD., Shenzhen (CN)

(72) Inventors: Qi Li, Shanghai (CN); Dong Qian, Shanghai (CN); Duzen Peng, Shanghai (CN)

( * ) Notice: Subject to any disclaimer, the term of this patent is extended or adjusted under 35 U.S.C. 154(b) by 0 days.

(21) Appl. No.: 16/102,738

(22) Filed: Aug. 14, 2018

(65) Prior Publication Data

US 2018/0357956 A1 Dec. 13, 2018

Related U.S. Application Data

(63) Continuation-in-part of application No. 15/181,557, filed on Jun. 14, 2016, now Pat. No. 10,078,979.

(30) Foreign Application Priority Data

Feb. 4, 2016 (CN) ..... 2016 1 0081027

(51) Int. Cl.
*G09G 3/3233* (2016.01)
*G09G 3/3266* (2016.01)

(52) U.S. Cl.
CPC ..... *G09G 3/3233* (2013.01); *G09G 3/3266* (2013.01); *G09G 2300/0426* (2013.01);
(Continued)

(58) Field of Classification Search
CPC ..... G09G 3/3233
(Continued)

(56) References Cited

U.S. PATENT DOCUMENTS 8,766,970 B2 7/2014 Chien et al.
2006/0044245 A1* 3/2006 Park ..... G09G 3/3233 345/92

(Continued)

FOREIGN PATENT DOCUMENTS

CN 1716369 A 1/2006
CN 104252845 A 12/2014

(Continued)

*Primary Examiner* — Long D Pham
(74) *Attorney, Agent, or Firm* — Kilpatrick Townsend & Stockton, LLP

(57) ABSTRACT

A method for driving an array substrate, the array substrate includes M rows of pixel units, each of the pixel units includes a shared driving circuit and N light-emitting components connected to the shared driving circuit, the method includes: in a period of scanning a frame of image, providing first to Nth scanning stages uniformly distributed to each row of pixel units, each of the scanning stages has a duration T, and any one of N scanning stages of an ith row of pixel units does not overlap with any one of N scanning stages of a jth row of pixel units; i, j and M are all positive integers, and $1 \leqslant i, j \leqslant M$, $i \neq j$; and N is a positive integer not less than 2; and driving, by the shared driving circuit, the N light-emitting components to emit light.

7 Claims, 8 Drawing Sheets

(52) U.S. Cl.
CPC ..... *G09G 2300/0465* (2013.01); *G09G 2300/0804* (2013.01); *G09G 2300/0819* (2013.01); *G09G 2300/0852* (2013.01); *G09G 2300/0861* (2013.01); *G09G 2300/0876* (2013.01); *G09G 2310/021* (2013.01); *G09G 2310/0251* (2013.01); *G09G 2310/0262* (2013.01); *G09G 2320/043* (2013.01); *G09G 2330/02* (2013.01)

(58) Field of Classification Search
USPC ..... 345/84
See application file for complete search history.

(56) References Cited

U.S. PATENT DOCUMENTS

| | | | | |
|---|---|---|---|---|
| 2006/0139257 | A1* | 6/2006 | Kwak | G09G 3/3233 345/76 |
| 2007/0085799 | A1* | 4/2007 | Hong | G09G 3/3648 345/94 |
| 2009/0051674 | A1* | 2/2009 | Kimura | G09G 3/3233 345/204 |
| 2012/0306840 | A1 | 12/2012 | Han | |
| 2014/0342478 | A1 | 11/2014 | Choi | |
| 2017/0061876 | A1* | 3/2017 | Cho | G09G 3/3233 |

FOREIGN PATENT DOCUMENTS

| | | | |
|---|---|---|---|
| CN | 204117568 | U | 1/2015 |
| CN | 104409042 | A | 3/2015 |

* cited by examiner

METHOD FOR DRIVING AN ARRAY SUBSTRATE HAVING A PLURALITY OF LIGHT EMITTING COMPONENTS

CROSS-REFERENCES TO RELATED APPLICATIONS

This application is a continuation-in-part of pending U.S. patent application Ser. No. 15/181,557, filed on Jun. 14, 2016, which claims priority to Chinese Application No. 201610081027.7 filed on Feb. 4, 2016, which are herein incorporated by reference in their entireties.

TECHNICAL FIELD

The present disclosure relates to the field of organic light-emitting display technologies, particularly to a method for driving an array substrate.

BACKGROUND

Compared with the conventional liquid crystal display panels, the organic light-emitting display panel has advantages such as fast response, high contrast and wide viewing angle etc. The organic light-emitting display panel can emit light because of the driving current generated by driving transistor in the saturation region. However, due to the reason such as the aging of the device, the threshold voltage of the driving transistor would drift, so that the driving current is changed, thereby causing the change in the luminance of light emitted by the organic light-emitting display panel and affecting the display uniformity.

For solving a problem of the non-uniform display of the light-emitting display panel due to the drift of the threshold voltage of the driving transistor, it is generally to design a circuit with complicated structures to compensate for the threshold voltage of the driving transistor. That is, it is required to provide a complicated compensation circuit for each light-emitting transistor. However, as the demands of increasing the resolution and of decreasing the pixel area in the light-emitting display panel, the challenge that the complicated circuit can be made in a reduced pixel area becomes increasing in processes. Hence, it is required to provide a technology by means of which the problem of the non-uniform display due to the drift of the threshold voltage of the driving transistor can be solved, and with which the processes of the related art can also be compatible, thereby improving the resolution of the light-emitting display panel.

SUMMARY

Embodiments provide a method for driving an array substrate, to solve the problem of the non-uniform display due to the drift of the threshold voltage of the driving transistor, and to be able to be compatible with the processes in the related art, thereby improving the resolution of the display panel.

A method for driving an array substrate is provided. The array substrate includes M rows of pixel units, each of the pixel units includes a shared driving circuit, and N light-emitting components connected to the shared driving circuit, the method includes: in a period of scanning a frame of image, first to Nth scanning stages uniformly distributed are provided to each row of pixel units, where each of the scanning stages has a duration T, and any one of N scanning stages of an ith row of pixel units does not overlap with any one of N scanning stages of a jth row of pixel units; where i, j and M are all positive integers, and $1 \leqslant i, j \leqslant M$, $i \neq j$; and N is a positive integer not less than 2; and, the N light-emitting components are driven to emit light by the shared driving circuit.

In the embodiments of the disclosure, a method for driving an array substrate is provided. The array substrate includes M rows of pixel units, each of the pixel units includes a shared driving circuit, and N light-emitting components connected to the shared driving circuit. The shared driving circuit is configured to drive, through each of the light-emitting control transistors, the light-emitting component electrically connected to the output terminal of the light-emitting control transistor to emit light, so that the adjacent N light-emitting components in a display panel may share one of the pixel units, that is, N light-emitting components may be disposed in an area of one of the pixel units, thereby simplifying the circuit structure of the display panel while providing the function of the pixel units in the related art, and hence by such pixel units, not only the problem of the non-uniform display of the organic light-emitting display panel due to the drift of the threshold voltage of the driving transistor can be solved, but also the resolution of the display panel can be improved significantly. In a period of scanning a frame of image, each row of pixel units has uniformly distributed first to Nth scanning stages, each of which has a duration of T; and, any one of the N scanning stages of the ith row of pixel units does not overlap with any one of the N scanning stages of the jth row of the pixel units. Where i, j, and M are all positive integers, and $1 \leqslant i, j \leqslant M$, $i \neq j$; N is a positive integer greater than or equal to 2. Therefore, there is no case where data writing time of the pixel units overlaps with each other thereby causing signal crosstalk during the period of scanning each frame of images.

DETAILED DESCRIPTION

For better understanding of the disclosure, the disclosure will be further described below with reference to the accompanying drawings and embodiments. It may be understood that some embodiments described herein are merely for explaining the present disclosure rather than limiting the present disclosure. Moreover, it is noted that only parts related to the disclosure, rather than the entire structure are shown in the accompanying drawings.

Figure 1:
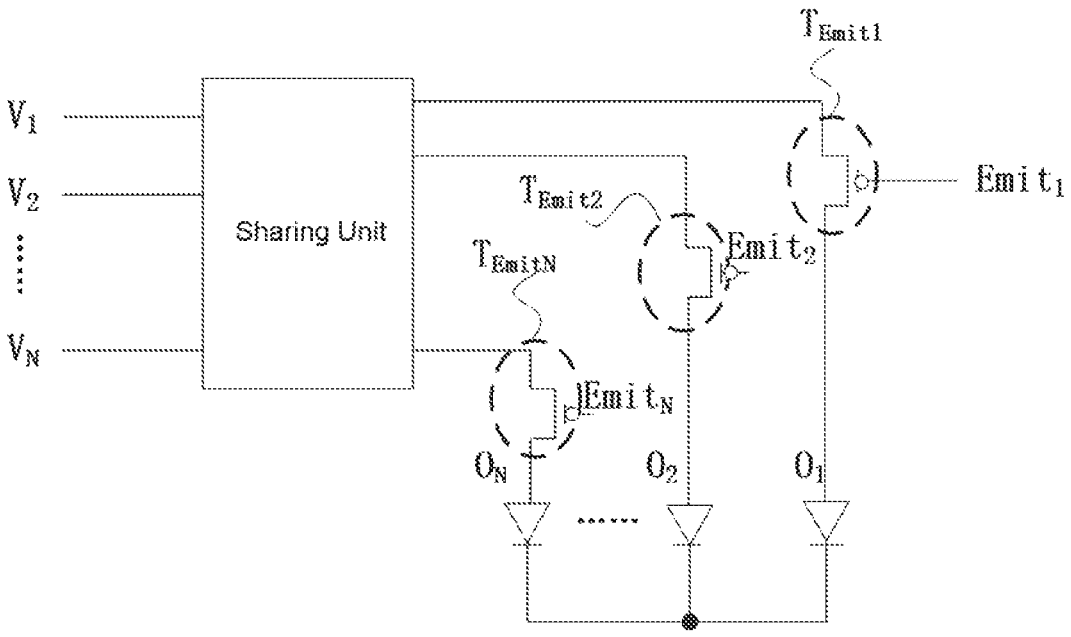
FIG. 1 is a schematic diagram showing the structure of a pixel unit provided by an embodiment of the disclosure.

FIG. 1 is a schematic diagram showing the structure of a pixel unit provided by an embodiment of the disclosure. As shown in FIG. 1, the pixel unit includes: a shared driving circuit and N light-emitting components $O_N$, where N is positive integer greater than or equal to two. The shared driving circuit is configured to drive the N light-emitting components to emit light. In an embodiment, the pixel unit may further include N light-emitting control transistors $T_{EmitN}$.

An input terminal of each of the light-emitting control transistors $T_{EmitN}$ is electrically connected to an output terminal of the shared driving circuit. An output terminal of each of the light-emitting control transistors $T_{EmitN}$ is electrically connected to an input terminal of a corresponding light-emitting component $O_N$, a control terminal of each of the light-emitting control transistors $T_{EmitN}$ is electrically connected to a corresponding control signal line $Emit_N$. An input terminal of the shared driving circuit is electrically connected to a data lines $V_N$, to receive corresponding data signals. The shared driving circuit is configured to drive, through each of the light-emitting control transistors $T_{EmitN}$, the light-emitting component $O_N$ electrically connected to the output terminal of the light-emitting control transistor $T_{EmitN}$ to emit light. Referring to the pixel unit shown in FIG. 1, it is noted that the pixel unit in FIG. 1 can control the N light-emitting components $O_N$ to emit light one by one, so that the N light-emitting components $O_N$ may be disposed above the region of the pixel unit in manufacturing the display panel, thus significantly improving the resolution of the display panel as compared with the configuration in the related art that one light-emitting component is disposed above one pixel unit.

Regarding the driving method for an array substrate in the present embodiment, the array substrate includes M rows of pixel units, each of the pixel units includes a shared driving circuit and N light-emitting components connected to the shared driving circuit. And the shared driving circuit is configured to drive the N light-emitting components to emit light. In a period of scanning a frame of image, each row of pixel units has uniformly distributed first to Nth scanning stages, each of which has a duration of T; and, any one of N scanning stages of an ith row of pixel units does not overlap with any one of N scanning stages of a jth row of the pixel units. Where i, j, and M are all positive integers, and $1 \leqslant i, j \leqslant M$, $i \neq j$; N is a positive integer greater than or equal to 2. Therefore, there is no case where data writing time of the pixel units overlaps with each other thereby causing signal crosstalk during the period of scanning each frame of images.

The shared driving circuit can be implemented in many ways, and the connection between the shared driving circuit and other devices of the pixel units can be implemented in many ways. And driving methods of the array substrate are also provided with various driving timings. The technical solutions of the embodiments of the present disclosure will be clearly and completely described below with reference to accompanying drawings. The embodiments described are just a part of the embodiments of the disclosure, rather than all the embodiments.

On the basis of the pixel unit provided in FIG. 1, in some embodiments, the shared driving circuit provided by an embodiment of the disclosure is electrically connected to a power signal line VDD, a data line $V_{DATA}$ and at least one first type scanning line SCAN, to receive a power supply voltage signal, data signals and at least one scan signal respectively.

For easy description, hereinafter, the data signal voltages of the data line are represented by $V_N$, the voltage of the power signal line is represented by VDD, the voltage of the corresponding first type scanning line is represented by SCAN. The voltage of the reference signal line is represented by $V_{ref}$.

Figure 2:
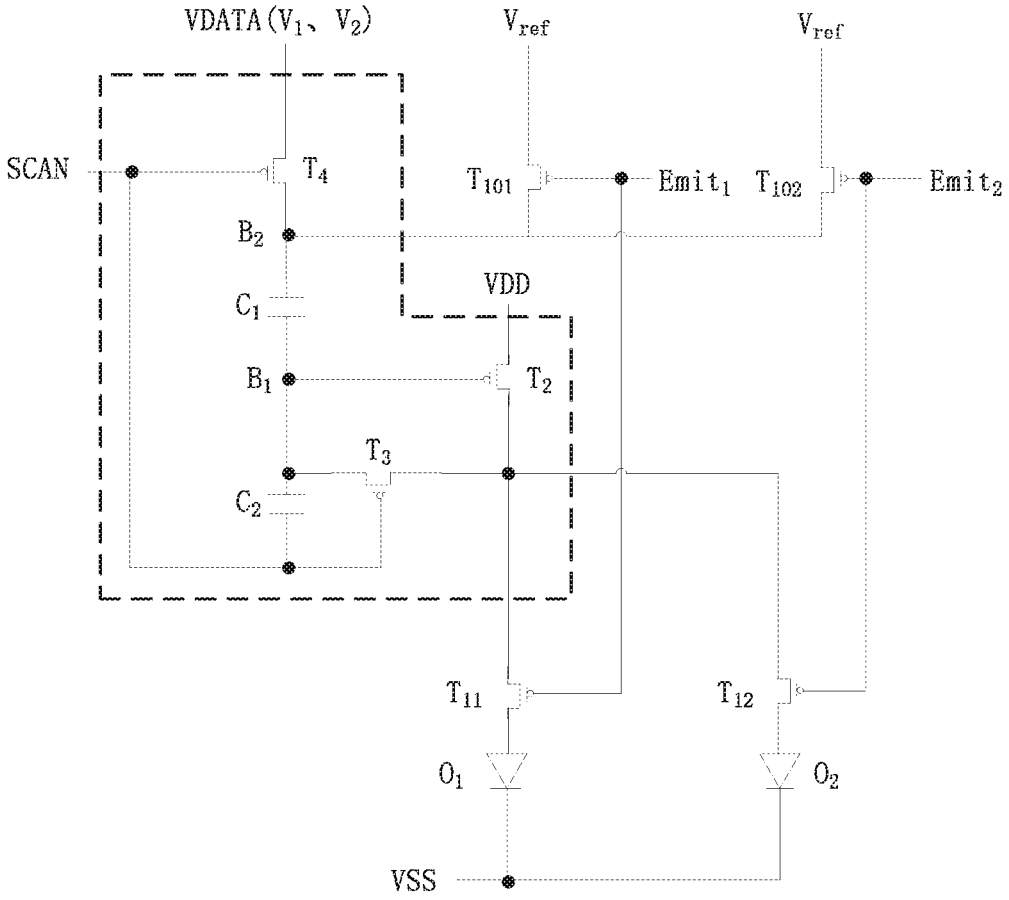
FIG. 2 is a schematic diagram showing the structure of another pixel unit provided by an embodiment of the disclosure.
Figure 4:
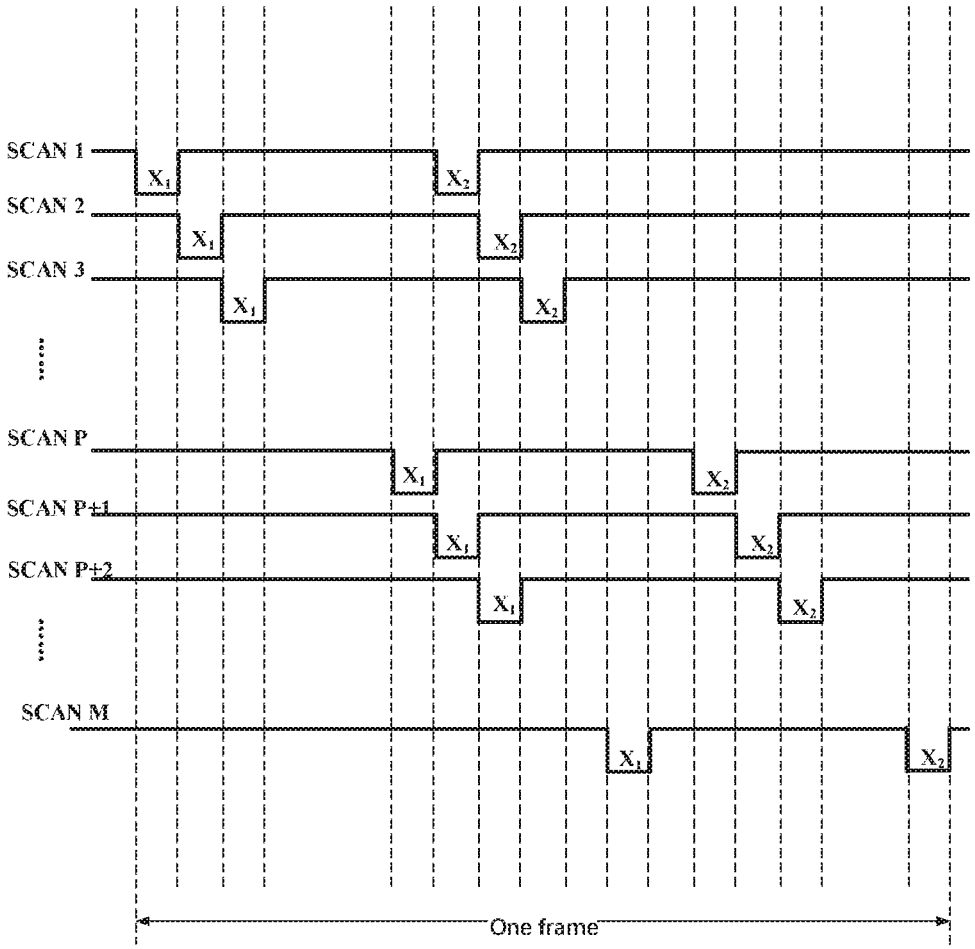
FIG. 4 is a timing diagram of a method for driving an array substrate provided in the related art.

FIG. 2 is a schematic diagram showing the structure of another pixel unit provided by an embodiment of the disclosure. The pixel unit further includes N first transistors. FIG. 4 illustratively shows two first transistors, namely the first transistor $T_{101}$ and the first transistor $T_{102}$ respectively. An input terminal of the first transistor $T_{101}$ and an input terminal of the first transistor $T_{102}$ both are electrically connected to a reference signal line $V_{ref}$. An output terminal of the first transistor $T_{101}$ and an output terminal of the first transistor $T_{102}$ both are electrically connected to an input terminal of the shared driving circuit. A control terminal of the first transistor $T_{101}$ is electrically connected to a control signal line $Emit_1$, and a control terminal of the first transistor $T_{102}$ is electrically connected to a control signal line $Emit_2$.

In one embodiment, the pixel unit further includes N light-emitting control transistors, an input terminal of each of the light-emitting control transistors is connected to an output terminal of the shared driving circuit; an output terminal of the each of light-emitting control transistors is connected to an input terminal of the light-emitting components; and a control terminal of the each of light-emitting control transistors is electrically connected with a respective one of control signal lines. Referring to FIG. 2, two light-emitting control transistors are respectively disposed, which are a light-emitting control transistor $T_{11}$ and a light-emitting control transistor $T_{12}$. An input terminal of the light-emitting control transistor $T_{11}$ and an input terminal of the light-emitting control transistor $T_{12}$ are connected to the output terminal of the shared driving circuit. An output terminal of the $T_{11}$ is connected to an input terminal of the light-emitting component $O_1$, an output terminal of the light-emitting control transistor $T_{12}$ is connected to an input terminal of the light-emitting component $O_2$, a control terminal of the light-emitting control transistor $T_{11}$ is electrically connected to the control signal line $Emit_1$, and a control terminal of the light-emitting control transistor $T_{12}$ is electrically connected to the control signal line $Emit_2$.

Referring to FIG. 2, the shared driving circuit (area surrounded by a dotted line) includes: a data writing transistor $T_4$, a second transistor $T_2$, a third transistor $T_3$, a first capacitor $C_1$, and a first capacitor $C_1$; An input terminal of the second transistor $T_2$ is electrically connected to a power supply signal line VDD, and a control terminal of the second transistor $T_2$ is electrically connected to a first terminal of the first capacitor $C_1$. An output terminal of the second transistor $T_2$ is electrically connected to an input terminal of each of the light-emitting control transistors (the light-emitting control transistor $T_{11}$ and the light-emitting control transistor $T_{12}$); An input terminal of the third transistor $T_3$ is electrically connected to the input terminal of the second transistor $T_2$. An output terminal of the third transistor $T_3$ is electrically connected to the first terminal of the first capacitor $C_1$ and a first terminal of the second capacitor $C_2$, and a control terminal of the third transistor $T_3$ is electrically connected to a first type scanning line SCAN and a second terminal of the second capacitor $C_2$. An input terminal of the data writing transistor $T_4$ is electrically connected to a corresponding data line $V_{DATA}$ (including $V_1$ and $V_2$), an output terminal of the data writing transistor $T_4$ is electrically connected to an input terminal of the shared driving circuit, and a control terminal of the data writing transistor $T_4$ is electrically connected to a corresponding first type scanning line SCAN. An output terminal of the first transistor $T_{101}$ and an output terminal of the first transistor $T_{102}$ are both electrically connected to a second terminal of the first capacitor $C_1$.

It is noted that, according to various embodiments, the first transistor $T_1$, the second transistor $T_2$, the third transistor $T_3$, the light-emitting control transistor $T_{12}$ and the data writing transistor $T_4$ may be N-channel transistors, or may be P-channel transistors. When light-emitting components are driven, each of the input signals (such as the values of the high level voltage and low level voltage) of each of the pixel units may be changed according to the channel types of the first transistor $T_1$, the second transistor $T_2$, the third transistor $T_3$, and the data writing transistor $T_4$. Similar to the above embodiments, the first transistor $T_1$, the second transistor $T_2$, the third transistor $T_3$, the light-emitting control transistor $T_{12}$ and the data writing transistor $T_4$ have a same channel type, thus simplifying the structure of the pixel unit and reducing the area occupied by the pixel unit.

Figure 3:
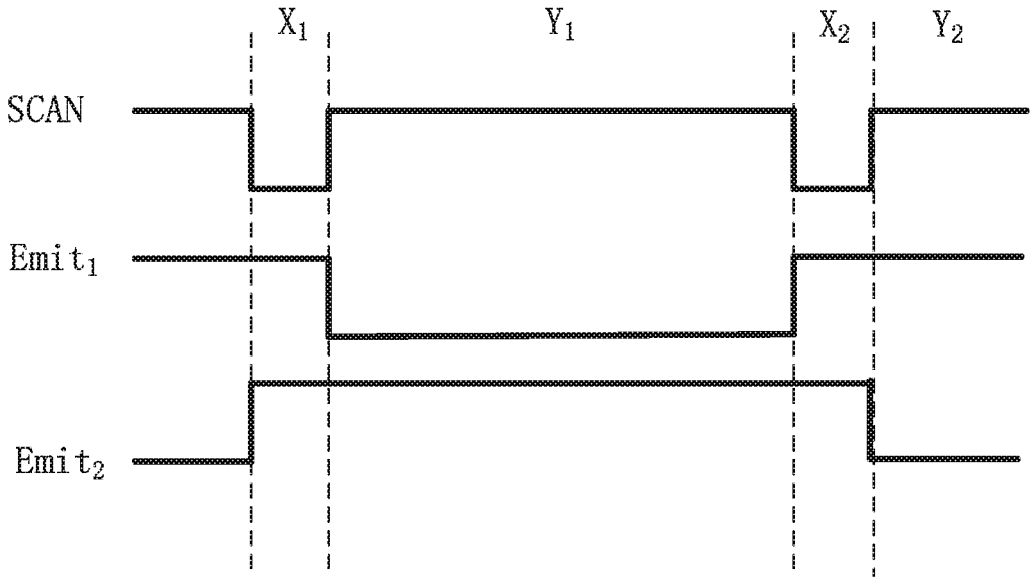
FIG. 3 is a timing diagram of a method for driving a pixel unit provided by an embodiment of the disclosure.

FIG. 3 is a timing diagram of a method for driving a pixel unit provided by the present embodiment. For instance, in combination of the pixel unit shown in FIG. 2 and the timing diagram of a timing diagram of a method for driving a pixel unit shown in FIG. 3, the first transistor $T_1$, the second transistor $T_2$, the third transistor $T_3$, the light-emitting control transistor $T_{12}$ and the data writing transistor $T_4$ are P-channel transistors, the method for driving the pixel unit includes the following steps: a first writing and compensating step $X_1$, a first light-emitting step $Y_1$, a second writing and compensating step $X_2$ and a second light-emitting step $Y_2$.

In the first writing and compensating step $X_1$, the scan signal of the first type scanning line SCAN is at low level. Under the control of the scan signal of the first type scanning line SCAN, the data writing transistor $T_4$ and the third transistor $T_3$ are turn on, so that the data signal $V_1$ is written into the second terminal (node $B_2$ in FIG. 4) of the first capacitor $C_1$ through the data line $V_1$. Also, due to the coupling effect of the second capacitor $C_2$, the value of the potential of the first terminal (node $B_1$ in FIG. 4) of the first capacitor $C_1$ is pulled down, so that the second transistor $T_2$ is turned on and the power supply voltage VDD is inputted through power supply signal line, and the current flows through the second transistor $T_2$ and the third transistor $T_3$, and hence the potential of the node $B_1$ is being continuously pulled up until the potential of the node $B_1$ is VDD-|Vth| (where Vth is the threshold voltage of the second transistor $T_2$), and then the second transistor $T_2$ is turned off.

In the light-emitting step $Y_1$, the input voltage of the control signal line $Emit_1$ is at low level. Under the control of the input voltage of the control signal line $Emit_1$, the first transistor $T_{101}$ and the light-emitting control transistor $T_{11}$ electrically connected to the control signal line $Emit_1$ are turned on, so that the reference voltage $V_{ref}$ is written into the second terminal (node $B_2$) of the first capacitor $C_1$ by the reference signal line $V_{ref}$. Due to the coupling effect of the capacitor, the potential of node $B_1$ is changed to $$\frac{C_1}{(C_1+C_2)}(V_{ref}-V_1)+VDD-|V_{th}|.$$

Then, the second transistor $T_2$ is turned on, so that the light-emitting component $O_1$ electrically connected to the light-emitting control transistor $T_{11}$ emits light. According to the current calculating formula for the light-emitting component $I=K(V_{SG}-|V_{th}|)^2$, the current of the light-emitting component $O_1$ is $$I_1=K\left\{\left|VDD-\left[\frac{C_1}{(C_1+C_2)}(V_{ref}-V_1)+VDD-|V_{th}|\right]\right|-|V_{th}|\right\}^2=K\left[\frac{C_1}{(C_1+C_2)}(V_{ref}-V_1)\right]^2.$$

In the second writing and compensating step $X_2$, the scan signal of the first type scanning line SCAN is at low level. Under the control of the scan signal of the first type scanning line SCAN, the data writing transistor $T_4$ and the third transistor $T_3$ are turn on, so that the data signal $V_2$ is written into the second terminal (node $B_2$ in FIG. 4) of the first capacitor $C_1$ through the data line. Also, due to the coupling effect of the second capacitor $C_2$, the value of the potential of the first terminal (node $B_1$ in FIG. 4) of the first capacitor $C_1$ is pulled down, so that the second transistor $T_2$ is turned on and the power supply voltage VDD is inputted through the power supply signal line, the current flows through the second transistor $T_2$ and the third transistor $T_3$ and hence the potential of the node $B_1$ is being continuously pulled up until the potential of the node $B_1$ is VDD−|Vth| (Vth is the threshold voltage of the second transistor $T_2$), when the second transistor $T_2$ is turned off.

In the second light-emitting step $Y_2$, the input voltage of the control signal line $Emit_1$ is at low level. Under the control of the input voltage of the control signal line $Emit_1$, the first transistor $T_{101}$ and the light-emitting control transistor $T_{11}$ electrically connected to the control signal line $Emit_1$ are turned on, and the reference voltage $V_{ref}$ is written into the second terminal (node $B_2$) of the first capacitor $C_1$ by the reference signal line $V_{ref}$. The potential of node $B_1$ is changed to $$\frac{C_1}{(C_1+C_2)}(V_{ref}-V_2)+VDD-|V_{th}|$$

due to the capacitor coupling effect. At this moment, the second transistor $T_2$ is turned on and the light-emitting component $O_2$ electrically connected to the light-emitting control transistor $T_{11}$ emits light. According to the current calculating formula of the light-emitting component $I=K(V_{SG}-|V_{th}|)^2$, the current of the light-emitting component $O_2$ is $$I_2=K\left\{\left|VDD-\left[\frac{C_1}{(C_1+C_2)}(V_{ref}-V_2)+VDD-|V_{th}|\right]\right|-|V_{th}|\right\}^2=K\left[\frac{C_1}{(C_1+C_2)}(V_{ref}-V_1)\right]^2.$$

So far, scanning and displaying of a frame of image has finished, and the scanning and displaying display of the next frame of image will start when next SCAN 1 with a low level arrives. The display process is repeated in such a way.

In the present embodiment, the driving method for the array substrate enables the current of the light-emitting component to be independent of the threshold voltage of the second transistor (i.e., the driving transistor), thus effectively solving the problem of the non-uniform display due to the drift of the threshold voltage of the driving transistor. In addition, unlike the configuration in the related art that a pixel unit is provided for each of the light-emitting components and a complicated circuit is arranged in the region of the pixel unit including the light-emitting component in order to solve the problem of the non-uniform display due to the drift of the threshold voltage of the driving transistor. In the present embodiment, more than one light-emitting components is configured to share a pixel unit, so that the light-emitting components can be disposed in the region of the pixel unit. That is, more than one pixel units may be disposed in the region of the pixel unit, thus sufficiently decreasing the size of the pixel unit and significantly improving the resolution of the display panel.

In the case that the pixel unit includes N light-emitting control transistor, the driving method for the array substrate is performed as the following steps: a writing and compensating step and a light-emitting step.

In the writing and compensating step, under the control of a scan signal of the first type scanning line, the data writing transistor and the third transistor are turned on, so that the data line inputs the data signal to the second terminal of the first capacitor, the second capacitor pulls down the potential of the first terminal of the first capacitor, the second transistor is turned on, and the power signal line inputs the power supply, and the potential of the first terminal of the first capacitor increases until the second transistor is turn off.

In the light-emitting step, under the control of an input voltage of the control signal line, the first transistor and the light-emitting control transistor electrically connected to the control signal line are turned on, so that the reference signal line inputs the reference voltage to the second terminal of the first capacitor, and the second transistor is turned on, the light-emitting component electrically connected to the light-emitting control transistor emits light.

By this method, the writing and compensating step and the light-emitting step described above in sequence until the N light-emitting components emit light one by one.

It is noted that, the embodiment above described is explained in the case that the first transistors, the second transistor, the third transistor, the data writing transistor and the first transistors all have a P type channel. In the case that the first transistor, the second transistor, the third transistor, the data writing transistor and the first transistors all have a N type channel, the scan signal of each of the first type scanning lines, an input voltage of each of scanning signal lines and an input voltage of each of control signal lines are changed from a low level to a high level.

Since data signals at different times are inputted into the shared driving circuit as shown in FIG. 2 through one data line, thereby driving different light-emitting components to emit light, it is easy to cause the first writing and compensating step of the light-emitting components of different rows in the same column to be overlapped, resulting in crosstalk between the data signals. FIG. 4 is a timing diagram of a method for driving an array substrate provided in the related art. As shown in FIG. 4, SCAN 1 to SCAN M respectively represent scanning signals of the first type scanning lines corresponding to a first row to a Mth row of the pixel units. The low pulse of scan signal of the first type scanning line in FIG. 4 corresponds to the writing and compensating step of the light-emitting component. Referring to FIG. 4, the second writing and compensating step $X_2$ of the first row of pixel units overlaps with the first writing and compensating step $X_1$ of the P+1th row, and the second writing and compensating step $X_2$ of the second row of pixel units overlaps with the first writing and compensating step $X_1$ of the P+2th row of pixel units, . . . , which causes simultaneously writing data into the first half frame and data into the second half of the frame. And crosstalk between the data occurs, causing errors occur on the screen display.

Figure 5:
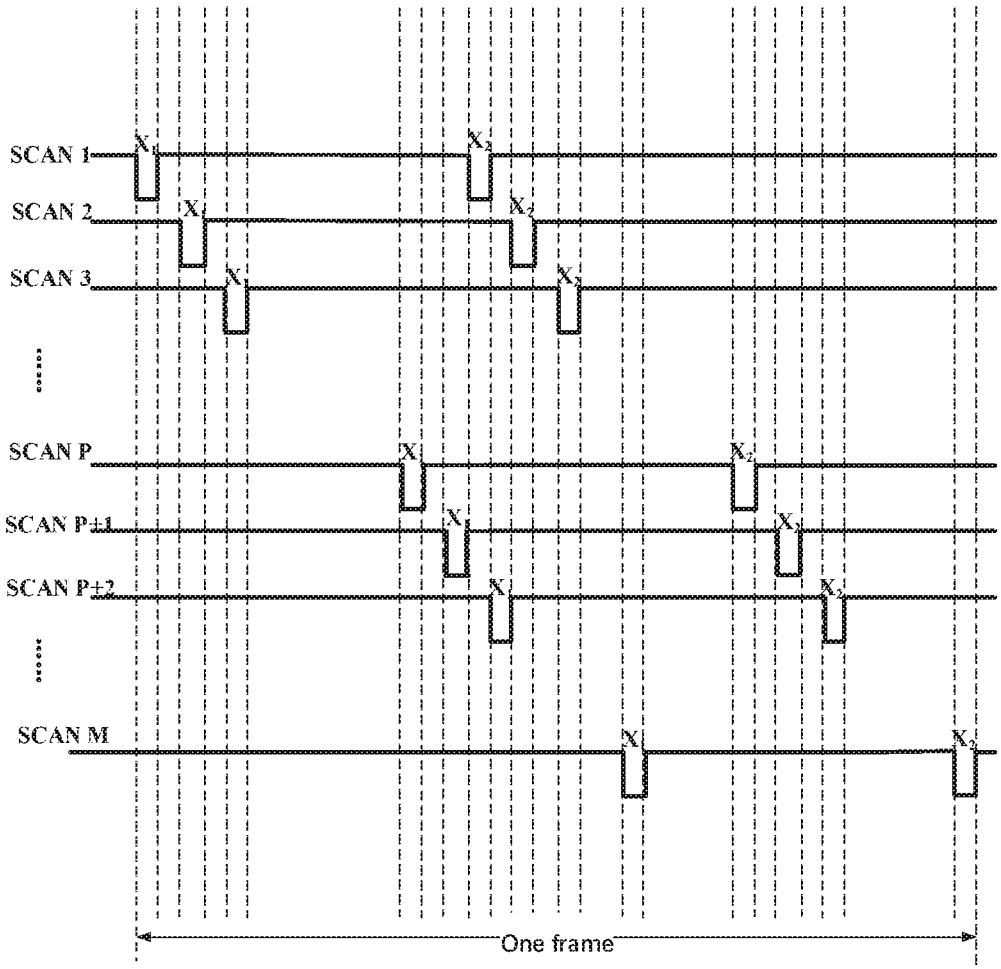
FIG. 5 is a timing diagram of a method for driving an array substrate provided by an embodiment of the disclosure.

Based on the above embodiments, FIG. 5 is a timing diagram of a method for driving an array substrate provided by an embodiment of the disclosure. The array substrate provided by the embodiment of the present disclosure includes M rows of pixel units. And each row of pixel units can be driven according to the driving method described in FIG. 3, and the structure of the pixel units can be shown in FIG. 2. In the period of scanning a frame of image, each row of pixel units is provided with first to Nth scanning stages uniformly distributed, each of which has a duration of T. Each of the scanning stages corresponds to the writing and compensating step of the pixel units. Referring to FIG. 5, the duration of the writing and compensating step is T. FIG. 5 is an example in which the shared driving circuit of each pixel unit drives two light-emitting components to emit light, that is, each row of pixel units are provided with uniformly distributed first scanning stage and second scanning stage. SCAN 1 to SCAN M respectively represent scan signals of the first type scanning lines corresponding to the first row of pixel units to the Mth row of pixel units. A duration T of one scanning stage is between the kth scanning stage of the i th row of pixel units and the kth scanning stage of the i+1th row of pixel units, $1 \leqslant k \leqslant N$, $1 \leqslant i \leqslant M-1$. As shown in FIG. 5, the time interval between the first writing and compensating steps X1 of any two adjacent rows of pixel units is the duration T of each of the scanning stages, and the time interval between the second writing and compensating steps $X_2$ of any two adjacent rows of pixel units is the duration T of each of the scanning stages. Since the duration T is the time interval between the kth scanning stages of any two adjacent rows of pixel units, the N scanning stages of the ith row of pixel units do not overlap with the N scanning stages of the jth row of pixel units. That is, scanning stages of any two rows of pixel units does not overlap with each other. The second writing and compensating step $X_2$ of the first row of pixel units does not overlap with the first writing and compensating step $X_1$ of the P+1th row; and the second writing and compensating step $X_2$ of the second row of pixels units does not overlap with the first writing and compensating step $X_1$ of the P+2th row of pixels units, . . . , so that crosstalk between data signals as shown in FIG. 4 can be avoided.

Since the time intervals between the kth scanning stages of any two rows of pixel units are equal, the driving timing shown in FIG. 5 in the embodiment of the present disclosure can be controlled in a manner that the M rows of pixel units are controlled by a same group of clock signal lines. That is, a gate driving circuit may be disposed on the periphery of the array substrate, and the gate driving circuit includes cascaded shift registers, and each of the shift registers is electrically connected to the corresponding first type scanning lines for driving the corresponding row of pixel units. All of the shift registers can share the same group of clock signal lines.

Figure 6:
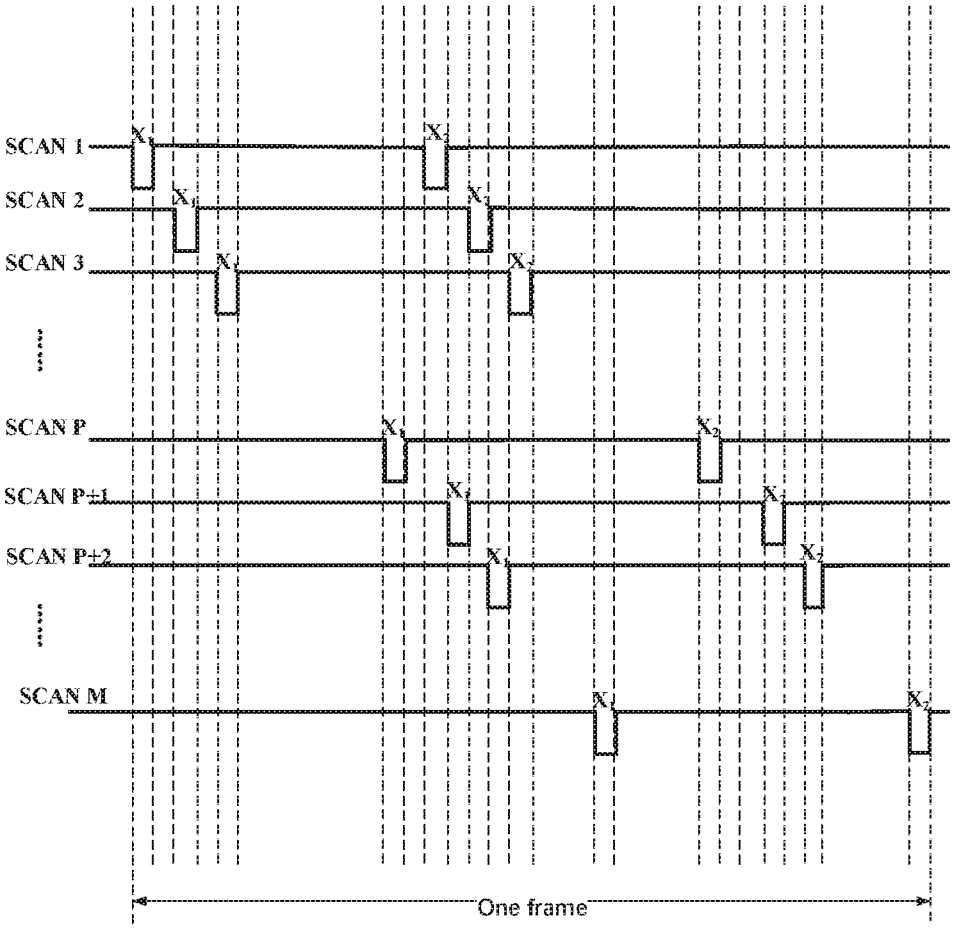
FIG. 6 is a timing diagram of another method for driving the array substrate provided by an embodiment of the disclosure.

FIG. 6 is a timing diagram of another method for driving the array substrate provided by an embodiment of the disclosure. The array substrate provided by the embodiment of the disclosure includes M rows of pixel units, and each row of pixel units can be driven according to the driving method as shown in FIG. 3. The structure of the pixel units can be shown in FIG. 2. In the period of scanning a frame of image, each row of pixel units has uniformly distributed first to Nth scanning stages, each of which has duration of T. Each of the scanning stages corresponds to the writing and compensating step of the pixel unit. Referring to FIG. 6, the writing and compensating step has a duration of T. FIG. 6 shows an example in which the shared driving circuit of each pixel unit drives two light-emitting components to emit light, that is, each row of pixel units has uniformly distributed first scanning stage and second scanning stage. SCAN 1 to SCAN M represent scan signals of the first type scanning lines corresponding to the first row to the Mth row of the pixel units. The time interval between the kth scanning stage of the ith row of the pixel units and the kth scanning stage of the i+1th row of the pixel units is the duration T of each of the scanning stage, $1 \leqslant k \leqslant N$, $1 \leqslant i<P$, or $P+1 \leqslant i \leqslant M$. The time interval between the kth scanning stage of the Pth row of the pixel units and the kth scanning stage of the P+1th row of the pixel units is 2T, the duration of two ones of the scanning stages. The number of P can be calculated by the following formula, that is, P is equal to the ratio of the time interval between the kth scanning stage and the k+1th scanning stage of the pixel units in a same row and the time required to scan a row of pixel units, and the time interval between the kth scanning stage and the k+1th scanning stage of one row of pixel units is equal to time for scanning one frame of image divided by N, and the time for scanning a row of pixel units is equal to the time for scanning one frame of image divided by M, so P=(Time interval between the kth scanning stage and the k+1th scanning stage of the pixel units in the same row)/Time for scanning one row of the pixel units=(time for scanning one frame image/N)/(the time for scanning the one frame of image/M)=M/N.

Referring to FIG. 6, regarding the first row to the Pth row of the pixel units, the time interval between the kth scanning stages of any two rows of pixel units is the duration T of the each of the scanning stages; in the P+1th row to the Mth row of the pixel units, the time interval between the kth scanning stages of any two rows of pixel units is the duration T of the each of the scanning stages; and the time interval between the kth scanning stage of the Pth row of the pixel units and the kth scanning stage of the P+1th row of the pixel units is 2T, a duration of two ones of the scanning stages.

In the first to Pth rows of the pixel units, the time interval between first writing and compensating steps $X_1$ of any two rows of pixel units is the duration T of the each of the scanning stages, and the time interval between the second writing and compensating steps $X_2$ of any two rows of pixel units is the duration T of the each of the scanning stages;

In the P+1th to Mth rows of pixel units, the time interval between the first writing and compensating steps $X_1$ of any two rows of pixel units is the duration T of the each of the scanning stages, and the time interval between the second writing and compensating steps $X_2$ of any two rows of pixel units is the duration T of the each of the scanning stages.

The time interval between a first writing and compensating step $X_1$ of the Pth row of the pixel units and a first writing and compensating step $X_1$ of the P+1th row of the pixel units is 2T, a duration of two ones of the scanning stages; and the time interval between a second writing and compensating step $X_2$ of the Pth row of the pixel units and a second writing and compensating step $X_2$ of the P+1th row of pixel units is 2T, the duration of two ones of the scanning stages.

Based on the driving timing as shown in FIG. 6, it can be also realized that the scanning stages of any two rows of pixel units do not overlap with each other, and crosstalk between data signal as shown in FIG. 4 can be avoided.

Referring to FIG. 6, regarding the first to Pth rows of the pixel units, the time interval between the kth scanning stages of any two rows of pixel units is the duration T of the each of the scanning stages; in the P+1th to Mth rows of the pixel units, the time interval between the kth scanning stages of any two rows of pixel units is the duration T of the each of the scanning stages; and the time interval between the kth scanning stage of the Pth row of the pixel units and the kth scanning stage of the P+1th row of the pixel units is 2T, a duration of two ones of the scanning stages. Therefore, two groups of the clock signal lines of the gate driving circuit disposed at periphery of the array substrate are required, the first to Pth rows of the pixel units are controlled by a first group of the clock signal lines, and the P+1th to Mth rows of the pixel units are controlled by a second group of clock signal lines.

Figure 7:
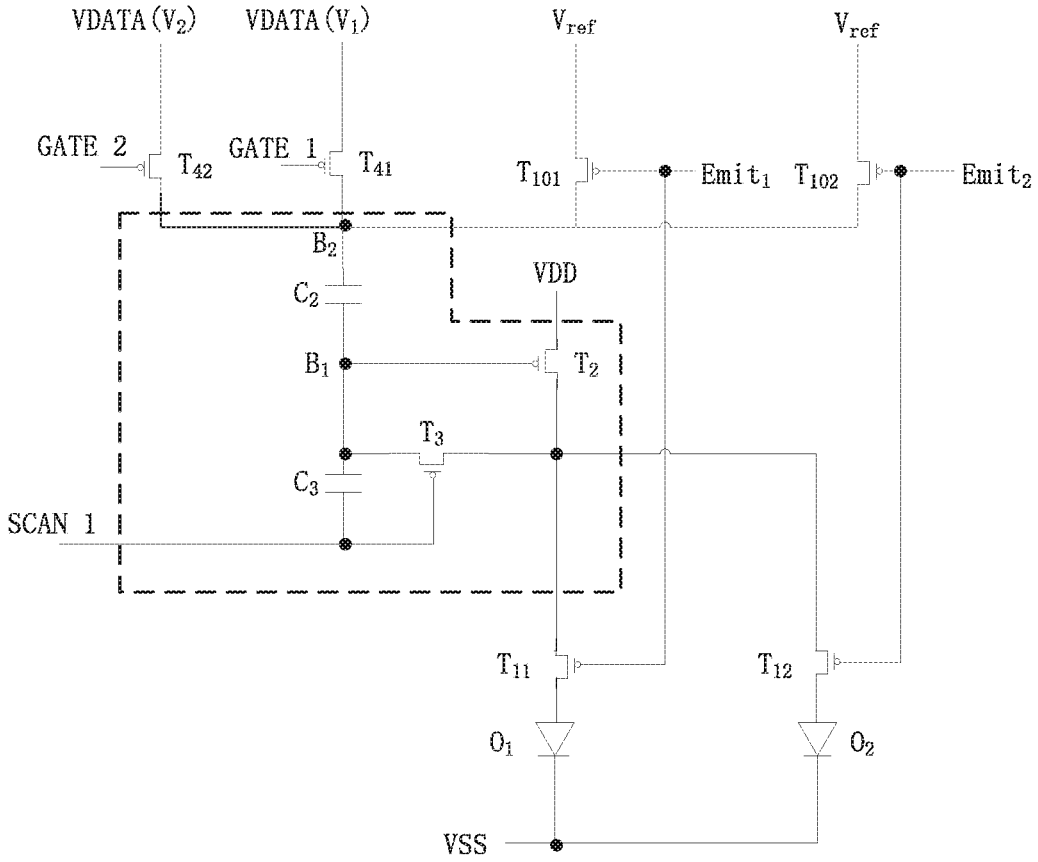
FIG. 7 is a schematic diagram showing the structure of another pixel unit provided by an embodiment of the disclosure.

FIG. 7 is a schematic diagram showing the structure of another pixel unit provided by an embodiment of the disclosure. As shown in FIG. 7, each of the pixel units includes a shared driving circuit (a part inside the dotted line frame in FIG. 7) and N light-emitting components connected to the shared driving circuit $O_N$. Where N is a positive integer greater than or equal to 2. The shared driving circuit is for driving the N light-emitting components to emit light. The each of pixel units further includes N light-emitting control transistors. For instance, referring to FIG. 7, two light-emitting control transistors are provided, respectively, a light-emitting control transistor $T_{11}$ and a light-emitting control transistor $T_{12}$, and two light-emitting components are provided, which are a light-emitting component $O_1$ and a light-emitting component $O_2$, respectively. The light-emitting control transistor $T_{11}$ and the light-emitting control transistor $T_{12}$ are connected to the output terminal of the shared driving circuit, the output terminal of the light-emitting control transistor $T_{11}$ is connected to the input terminal of the light-emitting component $O_1$, and the output terminal of the light-emitting control transistor $T_{12}$ is connected to the input terminal of the light-emitting component $O_2$. The light-emitting control transistor $T_{11}$ is electrically connected to the control signal line $Emit_1$, and the control terminal of the light-emitting control transistor $T_{12}$ is electrically connected to the control signal line $Emit_2$.

The each of pixel units further includes N data writing transistors, the input terminal of each of the N data writing transistors is electrically connected to a respective one of the data lines, the output terminal of each of the N data writing transistors is electrically connected to the input terminal of the shared driving circuit, and the control terminal of each of the N data writing transistors is electrically connected to a respective one of the second type scanning lines. FIG. 7 exemplarily sets two data writing transistors, which are a data writing transistor $T_{41}$ and a data writing transistor $T_{42}$, respectively. An input terminal of the data writing transistor $T_{41}$ is electrically connected to a data line $V_1$, an input terminal of the data writing transistor $T_{42}$ is electrically connected to a data line $V_2$, and an output terminal of the data writing transistor $T_{41}$ and an output terminal of the data writing transistor $T_{42}$ are electrically connected with an input terminal of the shared driving circuit. A control terminal of the data writing transistor $T_{41}$ is electrically connected to a second type scanning line GATE 1, and a control terminal of the data writing transistor $T_{42}$ is electrically connected to the second type scanning line GATE 2.

The shared driving circuit includes: a second transistor $T_2$, a third transistor $T_3$, a first capacitor $C_1$, and a second capacitor $C_2$. An input terminal of the second transistor $T_2$ is electrically connected to the power signal line VDD, and the control terminal of the second transistor $T_2$ is electrically connected to the first terminal of the first capacitor $C_1$; an output terminal of the second transistor $T_2$ is electrically connected to the input terminal of each of the light-emitting control transistors (the light-emitting control transistor $T_{11}$ and the light-emitting control transistor $T_{12}$);

The input terminal of the third transistor $T_3$ is electrically connected to the output terminal of the second transistor $T_2$, and the output terminal of the third transistor $T_3$ is electrically connected to the first terminal of the first capacitor $C_1$ and the first terminal of the second capacitor $C_2$ respectively, and the control terminal of the third transistor $T_3$ is electrically connected with the first type the first type scanning line SCAN 1 and the second terminal of the second capacitor $C_2$ respectively.

The pixel unit as shown in FIG. 7 requires three scanning lines, that is, each row of pixel units needs to be configured with three scanning lines, including one first type scanning line and two second type scanning lines. More generally, if the each of pixel units includes a shared driving circuit and N light-emitting components connected with the shared driving circuit, then each row of pixel units needs to be configured with N+1 scanning lines, including one first type scanning line and N second type scanning lines.

Figure 8:
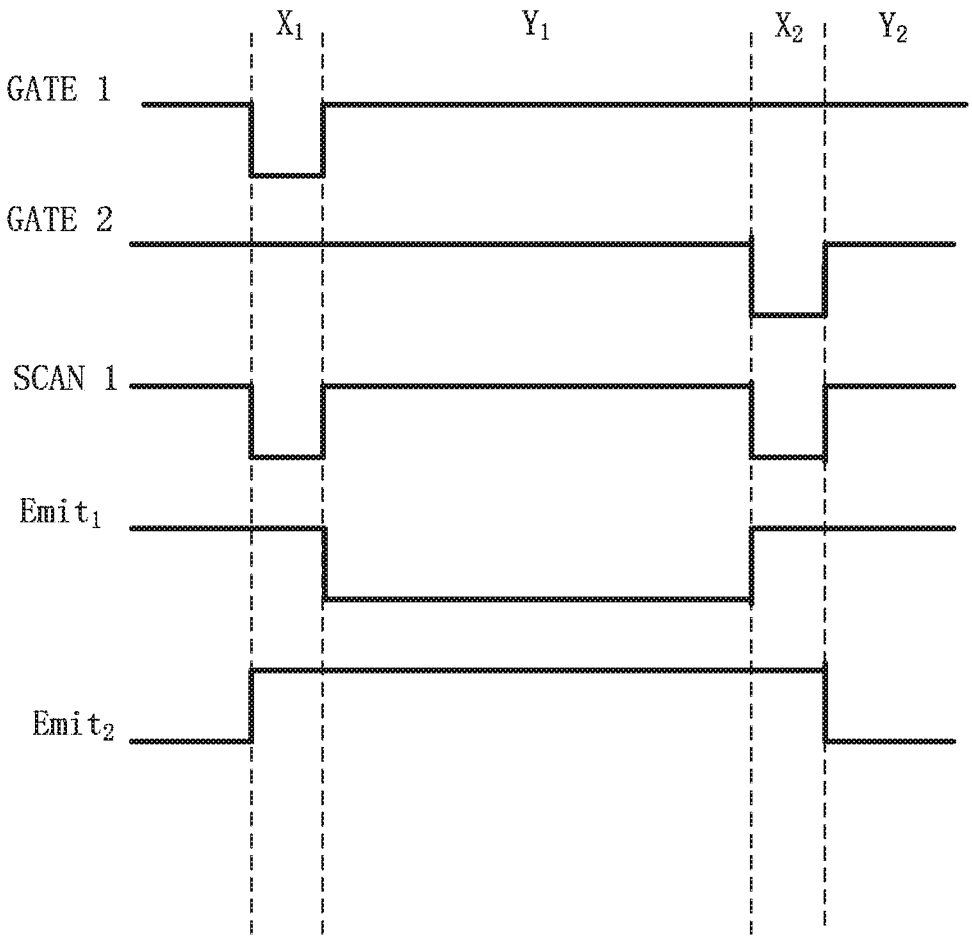
FIG. 8 is a timing diagram of a method for driving a pixel unit provided by an embodiment of the disclosure.

FIG. 8 is a timing diagram of a method for driving a pixel unit provided by an embodiment of the disclosure. In combination with the pixel unit as shown in FIG. 7 and a driving timing diagram of the pixel units as shown in FIG. 7, in the case that the first transistor, the second transistor, the third transistor, the light-emitting control transistor and the data writing transistor are P-channel transistors, the method for driving the pixel unit includes the following stages: a first writing and compensating step $X_1$, a first light-emitting step $Y_1$, a second writing and compensating step $X_2$ and a second light-emitting step $Y_2$.

In the first writing and compensating step $X_1$, the scan signal of the second type scanning line GATE 1 and the scan signal of the first type scanning line SCAN 1 are at low level, the second type scanning line GATE 2 is at high level. Under the control of the scan signals of the second type scanning line GATE 1, the second type scanning line GATE 2 and the first type scanning line SCAN 1, the data writing transistor $T_{41}$ and the third transistor $T_3$ are turned on, so that the data signal $V_1$ is written into the second terminal (node $B_2$ in FIG. 7) of the first capacitor $C_1$ through the data line $V_1$. Also, due to the coupling effect of the second capacitor $C_2$, the value of the potential of the first terminal (node $B_1$ in FIG. 4) of the first capacitor $C_1$ is pulled down, so that the second transistor $T_2$ is turned on and the power supply voltage VDD is inputted through power supply signal line, and the current flows through the second transistor $T_2$ and the third transistor $T_3$, and hence the potential of the node $B_1$ is being continuously pulled up until the potential of the node $B_1$ is VDD−|Vth| (where Vth is the threshold voltage of the second transistor $T_2$), and then the second transistor $T_2$ is turned off.

In the light-emitting step Y1, the input voltage of the control signal line $Emit_1$ is at low level. Under the control of the input voltage of the control signal line $Emit_1$, the first transistor $T_{101}$ and the light-emitting control transistor $T_{11}$ electrically connected to the control signal line $Emit_1$ are turned on, so that the reference voltage $V_{ref}$ is written into the second terminal (node $B_2$) of the first capacitor $C_1$ by the reference signal line $V_{ref}$. Due to the coupling effect of the capacitor, the potential of node $B_1$ is changed to $$\frac{C_1}{(C_1+C_2)}(V_{ref}-V_1)+VDD-|V_{th}|.$$

Then, the second transistor $T_2$ is turned on, so that the light-emitting component $O_1$ electrically connected to the light-emitting control transistor $T_{11}$ emits light. According to the current calculating formula for the light-emitting component $I=K(V_{SG}-|V_{th}|)^2$, the current of the light-emitting component $O_1$ is $$I_1=K\left\{\left|VDD-\left[\frac{C_1}{(C_1+C_2)}(V_{ref}-V_1)+VDD-|V_{th}|\right]\right|-|V_{th}|\right\}^2=K\left[\frac{C_1}{(C_1+C_2)}(V_{ref}-V_1)\right]^2.$$

In the second writing and compensating step $X_2$, the scan signal of the second type scanning line GATE 2 and the scan signal of the first type scanning line SCAN 1 are at low level, the second type scanning line GATE 1 is at high level. Under the control of the scan signals of the second type scanning line GATE 1, the second type scanning line GATE 2 and the first type scanning line SCAN 1, the data writing transistor $T_{42}$ and the third transistor $T_3$ are turned on, so that the data signal $V_2$ is written into the second terminal (node $B_2$ in FIG. 7) of the first capacitor $C_1$ through the data line. Also, due to the coupling effect of the second capacitor $C_2$, the value of the potential of the first terminal (node $B_1$ in FIG. 7) of the first capacitor $C_1$ is pulled down, so that the second transistor $T_2$ is turned on and the power supply voltage VDD is inputted through the power supply signal line, the current flows through the second transistor $T_2$ and the third transistor $T_3$ and hence the potential of the node $B_1$ is being continuously pulled up until the potential of the node $B_1$ is VDD−|Vth| (Vth is the threshold voltage of the second transistor $T_2$), at this moment, the second transistor $T_2$ is turned off.

In the second light-emitting step $Y_2$, the input voltage of the control signal line $Emit_1$ is at low level. Under the control of the input voltage of the control signal line $Emit_1$, the first transistor $T_{101}$ and the light-emitting control transistor $T_{11}$ electrically connected to the control signal line $Emit_1$ are turned on, and the reference voltage $V_{ref}$ is written into the second terminal (node $B_2$) of the first capacitor $C_1$ by the reference signal line $V_{ref}$. The potential of node $B_1$ is changed to $$\frac{C_1}{(C_1+C_2)}(V_{ref}-V_2)+VDD-|V_{th}|$$

due to the capacitor coupling effect. At this moment, the second transistor $T_2$ is turned on and the light-emitting component $O_2$ electrically connected to the light-emitting control transistor $T_{11}$ emits light. According to the current calculating formula of the light-emitting component $I=K(V_{SG}-|V_{th}|)^2$, the current of the light-emitting component $O_2$ is $$I_2=K\left\{\left|VDD-\left[\frac{C_1}{(C_1+C_2)}(V_{ref}-V_2)+VDD-|V_{th}|\right]\right|-|V_{th}|\right\}^2=K\left[\frac{C_1}{(C_1+C_2)}(V_{ref}-V_2)\right]^2.$$

So far, the scanning and displaying of a frame of image has finished, and the scanning and displaying of the next frame of image will start when next scan signal of the second type scanning line GATE 1 and next scan signal of the first type scanning line SCAN 1 is at low level, next second type scanning line GATE 2 is at high level SCAN 1. The display process is repeated in such a way.

More generally, in the case that each of the pixel units includes N light-emitting control transistor, the driving method for the array substrate is performed as the following steps: a writing and compensating step and a light-emitting step.

In the writing and compensating step, under the control of the scan signals of the first type scanning line and the second type scanning line, the data writing transistor and the third transistor are turned on, so that the data line connected with the data writing transistor inputs the data signal to the second terminal of the first capacitor, the second capacitor pulls down the potential of the first terminal of the first capacitor, the second transistor is turned on, and the power signal line inputs the power supply, and the potential of the first terminal of the first capacitor increases until the second transistor is turn off.

In the light-emitting step, under the control of an input voltage of the control signal line, the first transistor and the light-emitting control transistor electrically connected to the control signal line are turned on, so that the reference signal line inputs the reference voltage to the second terminal of the first capacitor, and the second transistor is turned on, the light-emitting component electrically connected to the light-emitting control transistor emits light.

By this method, the writing and compensating step and the light-emitting step described above are performed in sequence until the N light-emitting components emit light one by one.

It should be noted that, the above embodiment is described in the case that the first transistor, the second transistor, the third transistor, the data writing transistor, and the light-emitting control transistor all are P-channel transistors. In the case that the above embodiment is described based on that the first transistor, the second transistor, the third transistor, the data writing transistor, and the light-emitting control transistor all are N-channel transistors the scanning signal of the first type scanning line, the scanning signal of the second type scanning line and the input voltages of a respective one of control signal lines, as shown in FIG. 8, have an inverse level (being high or low) with respect to the case of P-channel transistors. In the above embodiment, data signals from the different data lines are written through different data writing transistors in FIG. 7, so that crosstalk between data signals caused by time-sharing controlling data signal writing as shown in FIG. 4 can also be avoided.

It is noted that, throughout FIG. 1 to FIG. 8, the same components are indicated by identical drawing reference numbers. The same components are not discussed repeatedly in detail.

What is claimed is:

1. A method for driving an array substrate, wherein the array substrate comprises M rows of pixel units, each row of the M rows of the pixel units comprises a shared driving circuit, and N light-emitting components connected to the shared driving circuit, the method comprises:

in a period of scanning a frame of image, providing first to Nth scanning pulses uniformly distributed to each row of pixel units, wherein each of the scanning pulses has a duration T, T>0, and any one of N scanning pulses of an ith row of pixel units does not overlap with any one of N scanning pulses of a jth row of pixel units; wherein i, j and M are all positive integers, and $1 \le i, j \le M$, $i \ne j$; and N is a positive integer not less than 2; and driving, by the shared driving circuit, the N light-emitting components to emit light; and wherein a time interval between a kth scanning pulse of the ith row of pixel units and a kth scanning pulse of the i+1th row of pixel units is the duration T of the each of the scanning pulses; a time interval between a kth scanning pulse of a Pth row of the pixel units and a kth scanning pulse of a P+1th row of the pixel units is 2T, a duration of two scanning pulses, and P=M/N; where k and P are positive integers, $1 \le k \le N$, and i and P satisfy $1 \le i \le M-1$ and $i \ne P$.

2. The method according to claim 1, further comprising: controlling the first to Pth rows of pixel units by a first group of clock signal lines, and controlling the P+1th to Mth rows of pixel units by a second group of clock signal lines.

3. The method according to claim 1, wherein the each of the pixel units further comprises N light-emitting control transistors, wherein an input terminal of each of the light-emitting control transistors is electrically connected to an output terminal of the shared driving circuit, and an output terminal of the each of light-emitting control transistors is electrically connected to an input terminal of a respective one of the light-emitting components; a control terminal of the each of light-emitting control transistors is electrically connected to a respective one of control signal lines.

4. The method according to claim 3, wherein the each of the pixel units further comprises N first transistors, wherein an input terminal of each of the first transistors is electrically connected to a respective one of reference signal lines, and an output terminal of the each of first transistors is electrically connected to the input terminal of the shared driving circuit; the control terminal of the each of first transistors is electrically connected to a respective one of control signal lines.

5. The method according to claim 4, wherein the shared driving circuit comprises: a data writing transistor, a second transistor, a third transistor, a first capacitor, and a second capacitor;

an input terminal of the second transistor is electrically connected to a power signal line, and a control terminal of the second transistor is electrically connected to a first terminal of the first capacitor; an output terminal of the second transistor is electrically connected to an input terminal of each of the light-emitting control transistors;

the input terminal of the third transistor is electrically connected to the output terminal of the second transistor, and the output terminal of the third transistor is electrically connected to the first terminal of the first capacitor and the first terminal of the second capacitor respectively, and the control terminal of the third transistor is electrically connected to a respective one of first type scanning lines and the second terminal of the second capacitor respectively; and the input terminal of the data writing transistor is electrically connected to a respective one of data lines, the output terminal of the data writing transistor is electrically connected to the input terminal of the shared driving circuit, and the control terminal of the data writing transistor is electrically connected to the respective one of the first type scanning lines.

6. The method according to claim 4, wherein the each of the pixel units further comprises N data writing transistors; and an input terminal of each of the N data writing transistors is electrically connected to a respective one of data lines; an output terminal of the each of the N data writing transistors is electrically connected to the input terminal of the shared driving circuit, and a control terminal of the each of the N data writing transistors is electrically connected to a respective one of second type scanning lines.

7. The method according to claim 6, wherein the shared driving circuit comprises: a second transistor, a third transistor, a first capacitor, and a second capacitor;

an input terminal of the second transistor is electrically connected to a power signal line, and a control terminal of the second transistor is electrically connected to a first terminal of the first capacitor; an output terminal of the second transistor is electrically connected to an input terminal of each of the light-emitting control transistors;

an input terminal of the third transistor is electrically connected to the output terminal of the second transistor, an output terminal of the third transistor is electrically connected to the first terminal of the first capacitor and a first terminal of the second capacitor respectively, and a control terminal of the third transistor is electrically connected with a respective one of first type scanning lines and a second terminal of the second capacitor respectively.

* * * * *